US005521228A

United States Patent [19]

Weber et al.

[11] Patent Number: 5,521,228

[45] Date of Patent: May 28, 1996

[54] SIMULATED HAIR

[76] Inventors: Michael R. Weber, 14535 Bruce B. Down Blvd., 2221 Tampa, Fla. 33613; Paul J. Weber, 2881 E. Oakland Park Blvd., Ft. Lauderdale, Fla. 33306

[21] Appl. No.: 373,407

[22] Filed: Jan. 17, 1995

[51] Int. Cl.[6] ..... C08F 2/46

[52] U.S. Cl. ..... 522/37; 522/96; 522/103; 132/201; 424/70.11; 424/78.17

[58] Field of Search ..... 132/201; 522/37, 522/96, 103; 424/70.11, 78.17

[56] References Cited

U.S. PATENT DOCUMENTS 5,362,486 11/1994 Nandagiri et al. ..... 424/78.17

*Primary Examiner*—Mark Chapman
*Attorney, Agent, or Firm*—John Lezdey

[57] ABSTRACT

A method for forming simulated hair strands on the scalp by utilizing a composition containing an ethylenically unsaturated monomer and a photoinitiator. The composition is applied to the scalp, strands are formed and the strands are cured by light.

12 Claims, No Drawings

SIMULATED HAIR

FIELD OF THE INVENTION

The present invention relates to a method and composition for forming simulated hair. More particularly, there is provided a method and composition comprising photopolymerizable olefinically unsaturated compounds which can be formed into strands to provide a realistic appearance of full hair on the scalp.

BACKGROUND OF THE INVENTION

The use of wigs and hairpieces are primarily for bald people or to supplement thinning hair. At the present there are no compositions which can create the appearance of hair on a person having bald patches.

To attempt to hide bald or balding areas on scalps, there have been some formulations which are paint-like that coat the scalp the same color as the user's hair. In this way, the contrast between the darker hair and the lighter scalp is reduced giving the appearance of fuller hair. These paints also adhere to the existing strands of hair remaining on the scalp giving the appearance of thicker hair. However, as a viewer gets closer to the user's scalp, the viewer can visibly discern that the user's scalp is coated with a non-natural powdery substance.

Other types of hair fillers are expensive and are not readily available for instant use.

SUMMARY OF THE INVENTION

According to the invention there is provided a method for simulating hair strands on the scalp and compositions which can be used therewith. The method comprises the steps of a) applying a composition comprising a photocurable ethylenically unsaturated monomer and/or polymer and a photoinitiator to a scalp, b) forming fibrous strands, and applying a light to polymerize and cure the strands.

Advantageously, the scalp where the strands are formed is provided with a base for attachment of the strands, for example, a silicon compound, collagen, a collodian gel or a plasticized hypoallergenic polymeric material.

Advantageously, the composition for forming the strands contains a light curable acrylic monomer.

It is therefore an object of the invention to provide a method for forming simulated hair on a scalp.

It is a further object of the invention to provide a composition which can be used to form hair-like strands.

It is another object of the invention to provide a photocurable composition which forms hair-like strands.

DESCRIPTION OF THE PREFERRED EMBODIMENTS

In accordance with one embodiment of the invention there is provided a method for placing simulated hair strands on the scalp to provide a fuller appearance for the hair. The method provides the application to the scalp or to a base on the scalp photopolymerizable ethylenically unsaturated compounds composition containing a photoinitiator. The composition is formed into hair-like strands and exposed to light so as to photocure the strands. The strands may then be cut to the desired length.

The photopolymerizable composition can be extruded through a nozzle having a plurality of apertures. One of such devices is a wand having a nozzle with a multiplicity of apertures which extrudes the composition after making initial contact with the scalp or base to which the strands adhere because of their tackiness. Preferably, a base which is tacky is placed on the scalp to aid in adherence of the hair-like strands. The base can be a collodian gel, collagen, an organic silicone compound such as a siloxane which is initially tacky or a hypoallergine polymeric substance which is initially tacky but is non-tacky when dry or cured. When the strands are adhered to the base, they can be drawn to a desired length and thickness and then cut. The application can be applied one or more times until a desired thickness or fullness is obtained. The strands when drawn can be exposed to a suitable light source to polymerize and cure the strands.

If a colorant is not added to the composition, the strands may be sprayed with a dye. If a dye is to be later sprayed, the composition can contain acid and base sites so as to hold the dye.

In accordance with a second embodiment of the invention there is provided a composition which forms hair-like strands that are photocurable. The composition comprises at least one ethylenically unsaturated monomer and/or polymer and a photoinitiator. Advantageously, the composition contains at least one acrylic monomer.

A preferred composition comprises a) a photocurable ethylenically unsaturated polymer or monomer in an amount of about 50 to 70% by weight of composition; b) a photocurable acrylated urethane in an amount of about 10 to 30% by weight, and c) a photoinitiator.

The ethylenically unsaturated monomers and/or polymers which can be used in the compositions of the invention include polyesters, unsaturated vinyl ester resins such as described in U.S. Pat. No. 3,367,992, α, β-olefinically unsaturated dicarboxylic acids or anhydrides and the like.

The ethylinically unsaturated, photocurable compounds useful in carrying out the invention are well known in the art. See, for example, U.S. Pat. Nos. 3,460,105; 3,429,795; 3,450,612 and 2,769,777. These ethylenically unsaturated photocurable compounds can be monomeric or polymeric compounds or mixtures thereof.

Examples of the more common ethylenically unsaturated, photocurable, monomeric compounds useful in the invention are the derivatives of acrylic and methacrylic acid such as esters, amides and nitriles. Examples of such compounds are methyl methacrylate, ethyl methacrylate, 2-ethylhexyl methacrylate, isobutyl methacrylate, butyl acrylate, 2-ethylhexyl acrylate, 2-hydroxyethyl acrylate, 2-methoxyethyl acrylate, 2-hydroxpropylacrylate, ethylene glycol di-acrylate, ethoxylated bisphenol A diacrylate, 1,4-tetramethylene di-methacrylate, trimethylolpropane tri-acrylate, pentaerythritol tetracrylate, alkyl methacrylate, alkyl acrylate, acrylated urethane, acrylamide, acrylonitrile, and diacetone acrylamide. The ethylenically unsaturated, photocurable compounds can also include acrylate capped or acrylate-terminated oligomers such as acrylate capped isocyanates and epoxy resins. Other unsaturated compounds useful in the invention are vinyl acetate, vinyl chloride, vinylidene chloride, styrene, alkylstyrenes, halostyrenes, and divinyl benzenes. Also, included are the compounds of the formula:

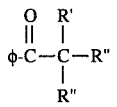

where ø is phenyl and R', R" and R"' are each independently hydrogen, halo, alkyl, alkoxy or phenyl, with the proviso that R', R" and R"' are not concurrently all hydrogen, all alkyl, or all phenyl. The various alkyl, alkoxy and phenyl groups comprising the molecule may be substituted to a minor extent with substituents which will not interfere with the utility of the compound as a photoinitiator. It is preferred that the alkyl, alkoxy and phenyl groups be unsubstituted. Examples of permissible substituents for the phenyl groups are halo, lower alkyl, lower alkoxy, carboxy and carbanoxy.

When R', R" or R"' is alkyl, it usually contains from 1 to about 6 carbon atoms. From 1 to about 4 carbon atoms is typical. The preferred alkoxy groups are methoxy and isobutoxy.

When R', R" or R"' are halo, it usually is fluoro, chloro or bromo. Chloro is preferred.

Suitable copolymerizable, ethylenically unsaturated, monomeric compounds are acrylate and methacrylate esters, allyl and, preferably, vinyl compounds, for example styrene, substituted styrene, p-chlorostyrene or vinyltoluene, esters of acrylic acid and methacrylic acid and methacrylic acid with alcohols of 1 to 18 carbon atoms, eg. methylacrylate, butylacrylate, ethylhexyl acrylate, hydroxypropyl acrylate, dihydrodoxyclopentadienyl acrylate and butanediol diacrylate, acrylamides and methacrylamides, allyl esters, eg. diallyl phthalate, and vinyl esters, eg. vinyl ethylhexanoate, vinyl divalate and the like. Mixtures of the said olefinically unsaturated monomers are also suitable. Preferred components are styrene, methylstyrene, chlorostyrene, vinyltoluene, divinylbenzene and diallyl phthalate.

Acylphosphine oxides which are particularly useful rapid photoinitiators are disclosed in U.S. Pat. No. 4,265,723 and consists of compounds of the formula:

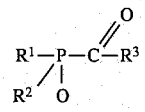

where $R^1$ is straight-chain or branched alkyl of 1 to 6 carbon atoms cyclohexyl, cyclopentyl, aryl which is unsubstituted or substituted by halogen, alkyl or alkoxy, or a S-containing or N-containing five-membered or six-membered heterocyclic radical, $R^2$ has one of the meanings of $R^1$ (but $R^1$ and $R^2$ may be identical or different) or is an alkoxy of 2 to 6 carbon atoms, aryloxy or araloxy, or $R^1$ and $R^2$ together form a ring, and $R^3$ is straight-chain or branched alkyl of 2 to 18 carbon atoms, a cycloaliphatic radical of 2 to 10 carbon atoms, phenyl, naphthyl or a S, O, or N containing five-membered or six membered heterocyclic radical and may contain additional substituents, or is the group where $R^1$ and $R^2$ have the above meanings and X is phenylene or aliphatic or cycloalipatic divalent radical of 2 to 6 carbon atoms, and one or more of the radicals $R^1$ to $R^3$ may be olefinically unsaturated.

The aliphatic and aromatic phosphates which may be utilized as photoinitiators are disclosed in the U.S. Pat. No. 4,116,788. Examples for the phosphites to be used as activators according to the invention are listed as follows: dimethylphosphite, dioctylphosphite, diphenyl-phosphite, tri(i-octyl) phosphite, tristearyl phosphite, trimethylphosphite, triethyl-phosphite, tri (i-propyl)phosphate, tris(allyl)phosphite, didecyl-phenyl-phosphite, tris(4-nonphenyl)phosphite, and tris-4 chlorophenyl-phosphite.

Photosensitizers which have a triplet energy in the range from about 54 to 72 kilocalories per mole which may be utilized in the invention. They are disclosed in U.S. Pat. No. 4,017,652 and include benzil, 3,4-benzofluorene, 4-naphthaldehyde, 1-acetylnaphthalene, 2,3-butanedione, 1-benzoylnaphthalene, 9-acetylphenanthrene, 3-acetylphenanthrene, 2-napthaldehyde, 2-benzoylnaphthalene, 4-phenylacetophenone, anthraquinone, thioxanthone, 3,4-methylenedioxyacetophenone, 4-cyanobenzophenone, 4-benzoylpyridine, 2-benzoylpridine, 4,4-dichlorobenzophenone, 4-trifluoromethylbenzophenone, 3-chlorobenzophenone, 4-methoxybenzophenone, 3,4-dimethylbenzophenone, 4-methylbenzophenone, benzophenone, 2-methylbenzophenone, 4—4'-dimethylphenone, 2,5-dimethylbenzophenone, and 2,4-dimethylbenzophenone.

Conventional curing inhibitors or retarders which may be used in the compositions of the invention in order to stabilize the components or curable compositions to prevent premature onset of curing include hydroquinone; p-tertiary butyl catechol; 2,6-ditertiary butyl-p-methylphenol; phenothiazine; N-phenyl-2-naphthylamine.

The compositions to be cured, i.e. (converted to fibrous strands) in accord with the present invention may, if desired include additives or antioxidants, accelerators, dye, inhibitors, activators, fillers, pigments, antistatic agents, surface-active agents, viscosity modifiers, extending oils, plasticizers and the like in an amount not to impair the purpose of this invention. In the case where photocuring by irradiation with ultraviolet rays or visible light rays is used, it is necessary that the curable composition remains transparent or translucent to visible light rays.

Prior to curing, the curable liquid polymer may be formulated for use as 100% dissolved or dispersed in organic solvents, or as dispersions or emulsions in aqueous media.

The curable liquid monomer or oligomer compositions prior to curing may readily be pumped, extruded, brushed, doctored or otherwise handled as desired. Following application, curing in place to a hair-like strand may be effected either very rapidly or extremely slowly as desired by manipulation of the compounding ingredients and the method of curing.

The liquid monomer or oligomer compositions prior to curing may be admixed with other monomeric and polymeric materials. The resulting blend may be subjected to conditions for curing or curing of the various components of the blend to give cured products having the desired hair-like unusual physical properties.

In many applications the curing is accomplished conveniently and economically by operating at ambient room conditions.

The radiation sources used according this invention to generate free radicals which initiate the curing reaction and emit light in the absorption region of photoinitiator compounds, i.e. from 230 mm to 450 mm. Sunlight, low pressure, medium pressure and high pressure mercury lamps are particularly suitable, superactinic fluorescent tubes or pulse lamps are particularly suitable. These lamps may or may not be doped. It is understood that the light sources for use in the invention also include multi-or monochromatic light as well as infrared radiation.

Preferred in the photocuring process are the conventional photoinitiators or mixtures thereof which have triplet energy in the range of from about 54–72 kilocalories per mole which promote the curing reaction.

The term "cure" is used herein to describe the process steps which result in a crosslinking reaction in a polymer whereby chains of the polymer become attached to each other by chemical bonds on exposure to a source of radiation.

EXAMPLE 1

A. 8 parts of acrylated urethane is heated to 130° F. and mixed with 2 parts of ethoxylated bisphenol A diacrylate (SR 349 monomer obtained from Sartomer Co., West Chester, Pa.). After thorough mixing 4% by weight of mixture of benzil dimethyl ketal is added. The mixture is allowed to come to room temperature in the dark.

B. Collodian gel is added to a scalp at an area of balding. Prior to the gel drying the composition from Part A is ejected from a wand having a multi-apertured nozzle so as to form strands. Simultaneously, the strands are exposed to a super-actinic fluorescent lamp. The cured strands are cut and new strands are placed on the gel until a desired thickness is achieved.

If desired, the composition of part A can contain a colorant or alternatively the polymeric strands can be spray dyed.

What is claimed is:

1. A method for forming simulated hair strands on a bald place on the scalp which comprises the step of:

a. applying a composition comprising a photo curable ethylenically unsaturated monomer and a photoinitiator to the scalp;

b. forming fibrous hair-like strands from said composition, and c. applying a light to polymerize and cure said strands and afix them to the scalp.

2. The method of claim 1 wherein the scalp is provided with a base and said composition is applied to said base.

3. The method of claim 2 wherein the composition is extruded onto said base and simultaneously light cured.

4. The method of claim 2 wherein said composition is applied to said base and strands are formed from the composition on said base before polymerizing and curing said strands.

5. The method of claim 2 wherein said base comprises collagen.

6. The method of claim 2 wherein said base is formed from a collodian gel.

7. The method of claim 1 wherein said composition contains a colorant.

8. The method of claim 1 including adding a colorant to said strands.

9. The method of claim 1 wherein said monomer comprises at least one acrylic monomer.

10. The method of claim 9 wherein said acrylic monomer comprises ethoxylated bisphenol A diacrylate.

11. The method of claim 10 including an acrylated urethane.

12. The method of claim 11 wherein said photoinitiator is benzil dimethyl ketal.

* * * * *